US008414079B1

(12) United States Patent
Zenoff

(10) Patent No.: US 8,414,079 B1
(45) Date of Patent: Apr. 9, 2013

(54) ADJUSTABLE STOOL

(75) Inventor: Andrew R. Zenoff, San Francisco, CA (US)

(73) Assignee: Andrew R. Zenoff, San Francisco, CA (US)

( * ) Notice: Subject to any disclaimer, the term of this patent is extended or adjusted under 35 U.S.C. 154(b) by 214 days.

(21) Appl. No.: 13/046,616

(22) Filed: Mar. 11, 2011

(51) Int. Cl.
*A47C 16/02* (2006.01)

(52) U.S. Cl. ..... 297/423.46; 297/423.39; 297/423.41; 297/423.44

(58) Field of Classification Search ..... 297/423.39, 297/423.41, 423.43, 423.44, 423.46
See application file for complete search history.

(56) References Cited

U.S. PATENT DOCUMENTS 789,813 A * 5/1905 Longley ..... 297/423.46 X
2,528,331 A * 10/1950 Bell ..... 297/423.46
2,566,498 A * 9/1951 Revercomb ..... 297/423.46
2,850,081 A * 9/1958 Dillon ..... 297/423.46 X
2,869,620 A * 1/1959 Gleitsman ..... 297/423.46 X
2,912,046 A * 11/1959 Fuerst ..... 297/423.46 X
D195,621 S * 7/1963 Longbaum ..... 297/423.46 X
3,121,551 A * 2/1964 Ancell et al. ..... 297/423.46 X
3,143,375 A * 8/1964 Langbaum ..... 297/423.46
3,160,381 A * 12/1964 Langbaum ..... 297/423.46 X
3,163,468 A * 12/1964 Koch ..... 297/423.46
3,940,181 A * 2/1976 Cheek, Jr. ..... 297/423.46
4,549,767 A * 10/1985 Hampshire et al. ..... 297/423.46
4,873,966 A * 10/1989 Gitter ..... 297/423.46 X
5,234,396 A * 8/1993 Wilkinson ..... 297/423.46 X
5,294,180 A * 3/1994 Grimm ..... 297/423.44
5,348,377 A * 9/1994 Grosch ..... 297/423.46 X
5,356,203 A * 10/1994 Levasseur et al. ... 297/423.46 X
5,419,618 A * 5/1995 Hatcher ..... 297/423.46
5,577,806 A * 11/1996 Ugalde ..... 297/423.46
5,584,535 A * 12/1996 Jacobson et al. ..... 297/423.46
5,626,393 A * 5/1997 Levasseur et al. ..... 297/423.46
5,765,921 A * 6/1998 Chuang ..... 297/423.46
6,682,147 B1 * 1/2004 Leoutsakos ..... 297/423.41
6,846,043 B1 * 1/2005 Leoutsakos ..... 297/423.46
7,708,348 B2 * 5/2010 Barr ..... 297/423.46
8,267,477 B1 * 9/2012 Appiah Finn ..... 297/423.41

* cited by examiner

*Primary Examiner* — Rodney B White
(74) *Attorney, Agent, or Firm* — Womble Carlyle Sandridge & Rice, LLP

(57) ABSTRACT

A support stool is provided. The support stool includes a pivotable top plate and a first support beam pivotably affixed to a bottom surface of the top plate. A first support block and a second support block are affixed to the bottom surface of the top plate. First and second footplates are coupled to corresponding ends of the first support beam and a second support beam, wherein the first and second support blocks are spaced apart from opposing side surfaces of the first and second support beams. The support stool includes a first holding member extending through the first footplate and the first holding member extends partially into a surface of the first support block.

17 Claims, 6 Drawing Sheets

ADJUSTABLE STOOL

BACKGROUND

Breast-feeding and bottle feeding may cause stress on a parent's legs, back, shoulders, and arms. The sitting position for the parent during the breast-feeding or bottle feeding directly affects the amount of stress placed on the legs, back, shoulders, and arms.

It is within this context that the embodiments arise.

SUMMARY

Embodiments include a support stool capable of adjusting the angular position of a top plate of the support stool. It should be appreciated that the present exemplary embodiments can be implemented in numerous ways, such as a process an apparatus, a system, a device or a method. Several inventive embodiments of the present invention are described below.

In one embodiment, a support stool is provided. The support stool includes a pivotable top plate and a first support beam pivotably affixed to a bottom surface of the top plate. A first support block and a second support block are affixed to the bottom surface of the top plate. First and second footplates are coupled to corresponding ends of the first support beam and a second support beam, wherein the first and second support blocks are spaced apart from opposing side surfaces of the first and second support beams. The support stool includes a first holding member extending through the first footplate and the first holding member extends partially into a surface of the first support block.

In another embodiment, a support stool is provided. The support stool includes a top plate. A first footplate and a second footplate are included. The support stool further includes a first beam and a second beam with ends of each beam being affixed to opposing surfaces of the first footplate and the second footplate. The first beam is pivotably mounted to a bottom surface of the top plate. The support stool includes a first support block and a second support block affixed to the bottom surface of the top plate. The first support block and the second support block are disposed within a region encompassed by the first footplate, the second footplate, the first beam, and the second beam.

Other aspects will become apparent from the following detailed description, taken in conjunction with the accompanying drawings, illustrating by way of example the principles of the exemplary embodiments.

BRIEF DESCRIPTION OF THE DRAWINGS

The invention may best be understood by reference to the following description taken in conjunction with the accompanying drawings.

DETAILED DESCRIPTION

Exemplary embodiments include an adjustable support stool. It will be obvious, however, that the present embodiments may be practiced without some or all of these specific details. In other instances, well-known operations have not been described in detail in order not to unnecessarily obscure the exemplary embodiments.

The embodiments provide a support stool that has an adjustable top plate. The is adjustable top plate pivots in order to accommodate different angles for optimum nursing support and comfort. Because of the adjustable nature of the stool, a comfortable position that alleviates stress on the back, shoulders, neck, etc., is more likely to be found.

Figure 1:
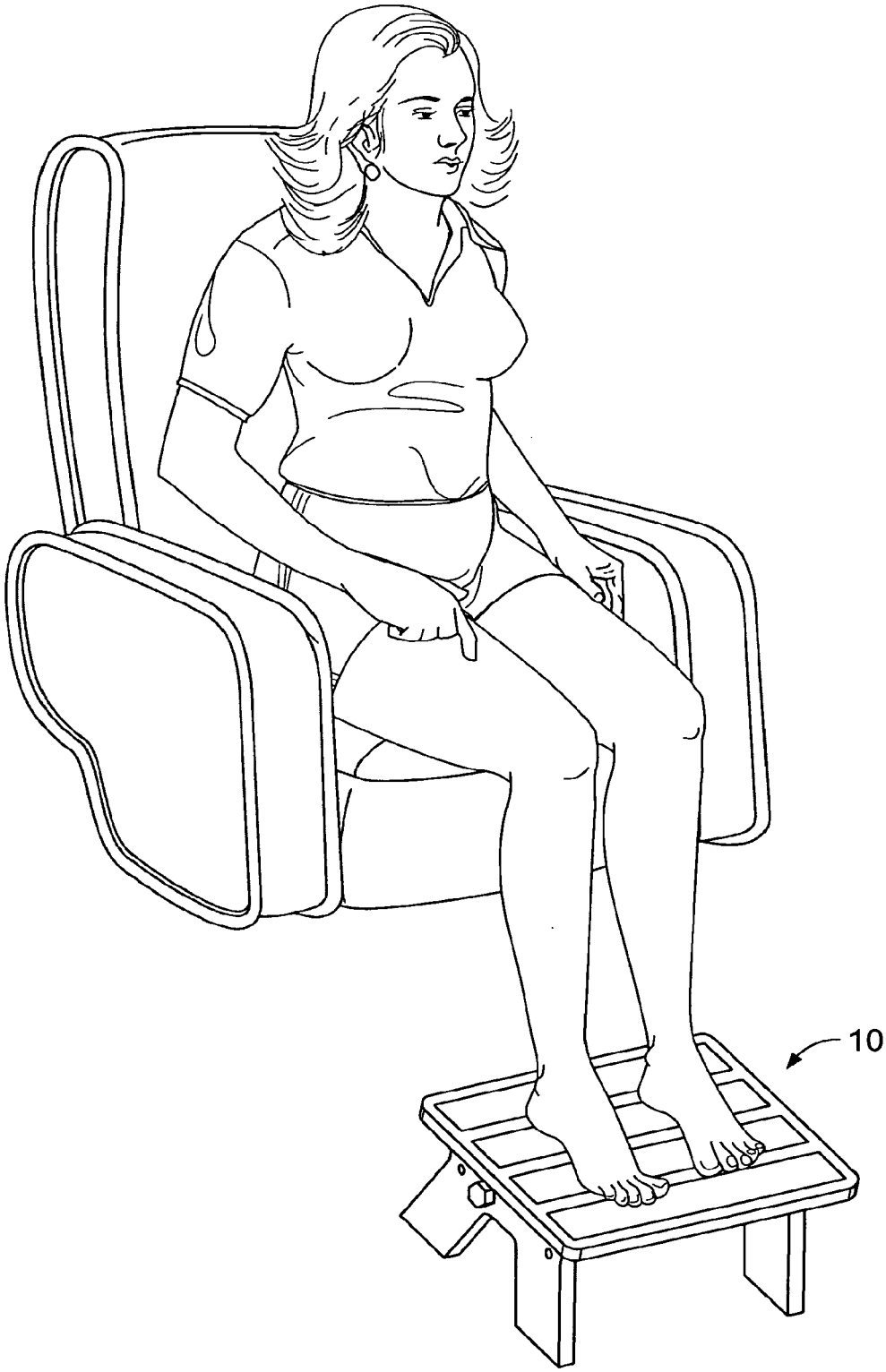
FIG. 1 is a simplified schematic diagram illustrating a nursing mother utilizing the adjustable stool in accordance with one embodiment of the invention.

FIG. 1 is a simplified schematic diagram illustrating a nursing mother utilizing the adjustable stool in accordance with one embodiment of the invention. As explained in more detail below adjustable stool 10 enables the nursing mother to comfortably and ergonomically adjust her sitting position. The adjustable stool enables positioning to alleviate stress placed on the back, legs, shoulders, neck and even wrist pain from repeated breast or bottle feeding. The stool enables elevation of the persons thighs in order to assist in supporting the baby. In addition, the angular adjustment of the top plate of the stool provides for a more comfortable ergonomic position.

Figure 2:
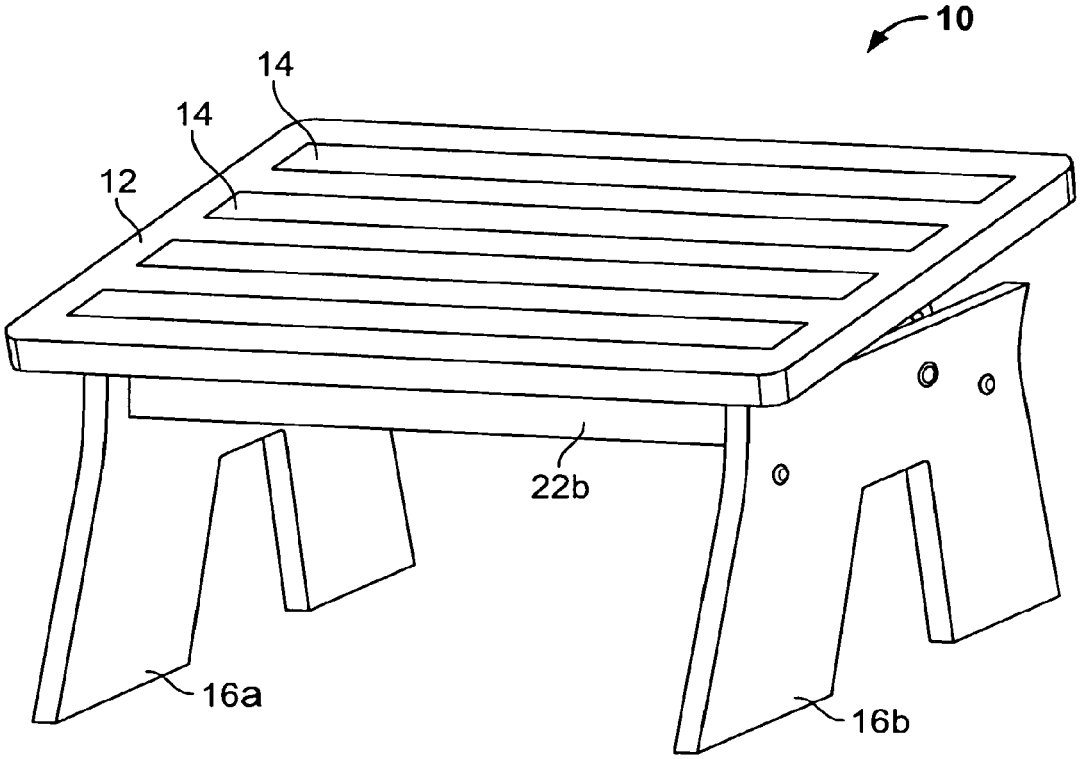
FIG. 2 is a simplified schematic diagram illustrating a perspective view of the adjustable stool in accordance with one embodiment of the invention.

FIG. 2 is a simplified schematic diagram illustrating a perspective view of the adjustable stool in accordance with one embodiment of the invention. Adjustable stool 10 includes top plate 12 movably supported by beam 22*b* and footplates 16*a* and 16*b*. On a top surface of the top plate 12 are strips 14. It should be appreciated that strips 14 are optional in one embodiment. The strips 14 provide a nonskid surface or may alternatively be an orthopedic pad. Top plate 12 is pivotably coupled to beam 22*b* through hinges in one embodiment. The hinged coupling enables top plate 12 to pivot around an axis of the coupling so that a distal end of the top plate is free to move, since the pivot point is proximate to an opposing end of the top plate. Footplates 16*a* and 16*b* are coupled to beam 22*b* in order to provide support for top plate 12 of the adjustable stool 10. A top surface of footplates 16*a* and 16*b*, and the corresponding beams, is flat to provide support against the bottom surface of top plate 12 when the top plate is in a non-raised position.

Figure 3:
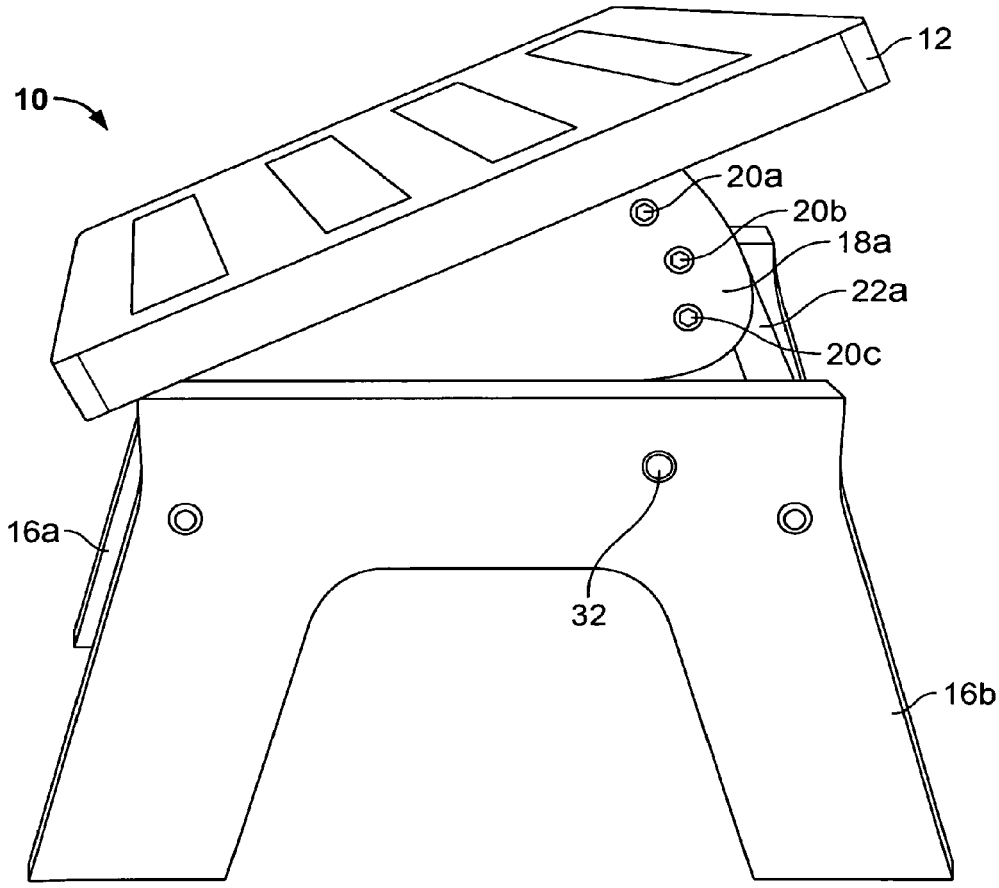
FIG. 3 is a simplified schematic diagram illustrating a perspective side view of the adjustable stool in accordance with one embodiment of the invention.

FIG. 3 is a simplified schematic diagram illustrating a perspective side view of the adjustable stool in accordance with one embodiment of the invention. Footplates 16*a* and 16*b* are coupled to each other through beam 22*a* and an opposing beam 22*b* as illustrated in FIGS. 2, 3, and 4B. A bottom surface of top plate 12 is affixed to support block 18*a* and corresponding support block 18*b* (see FIG. 4A). Support block 18*a* has a plurality of holes 20*a-c* that partially extend into the support block. It should be appreciated that holes 20*a-c* are radially aligned with a pivot axis for top plate 12. That is, the distance from the pivot axis to each of holes 20*a-c* is the same. As top plate 12 pivots around the hinged connection, a holding member disposed through hole 32 and any one of the corresponding holes 20 *a-c*, enables support for the variable angular positions of top plate 12. Footplates 16*a* and 16*b* are configured each with a pair of leg extensions that are angled outward. It should be noted that alternative configurations for footplates 16*a* and 16*b* may be integrated into the embodiments described herein.

Figure 4A:
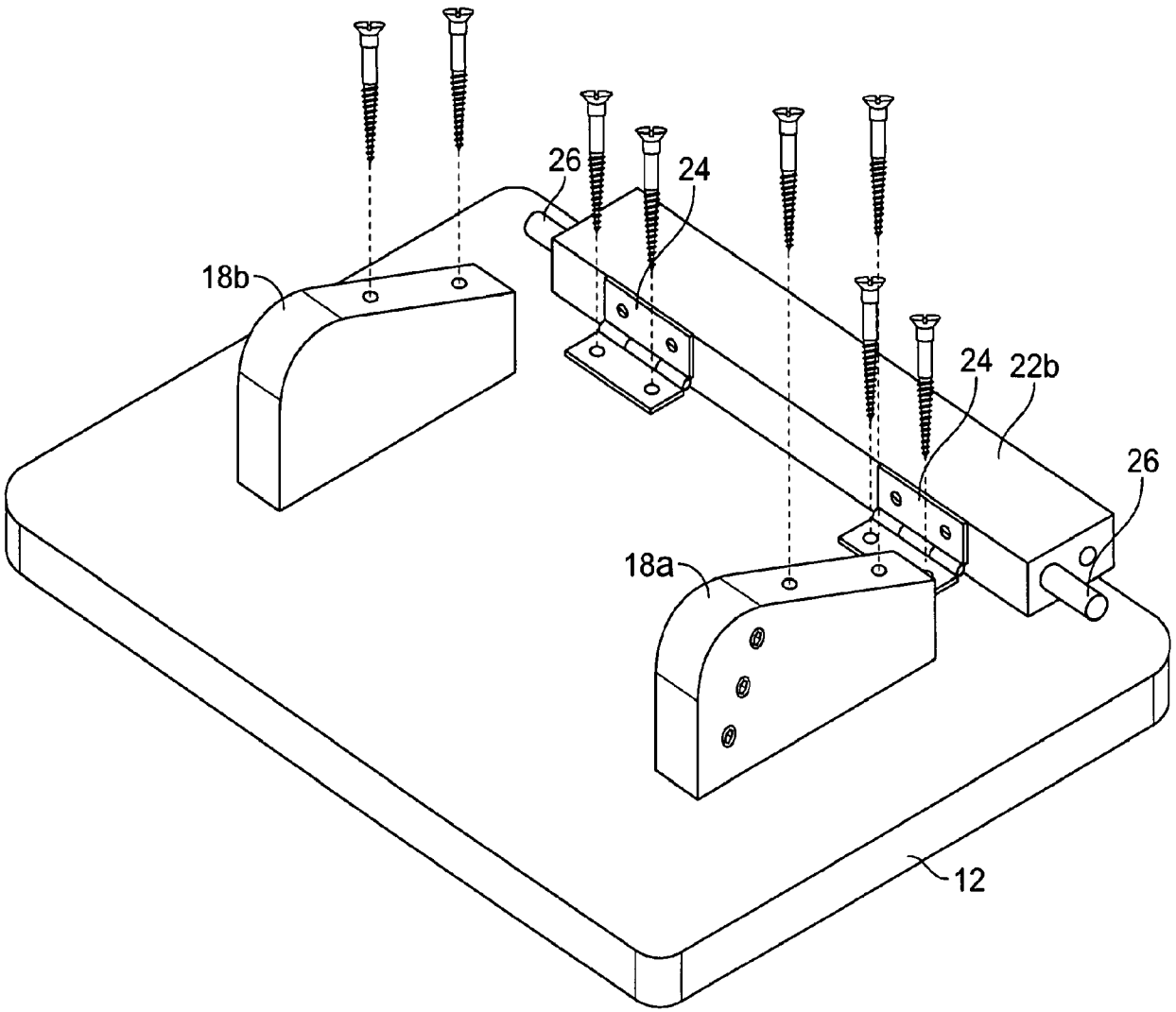
FIG. 4A is a simplified schematic diagram of a bottom perspective view of the partially assembled adjustable stool in accordance with one embodiment of the invention.
Figure 4B:
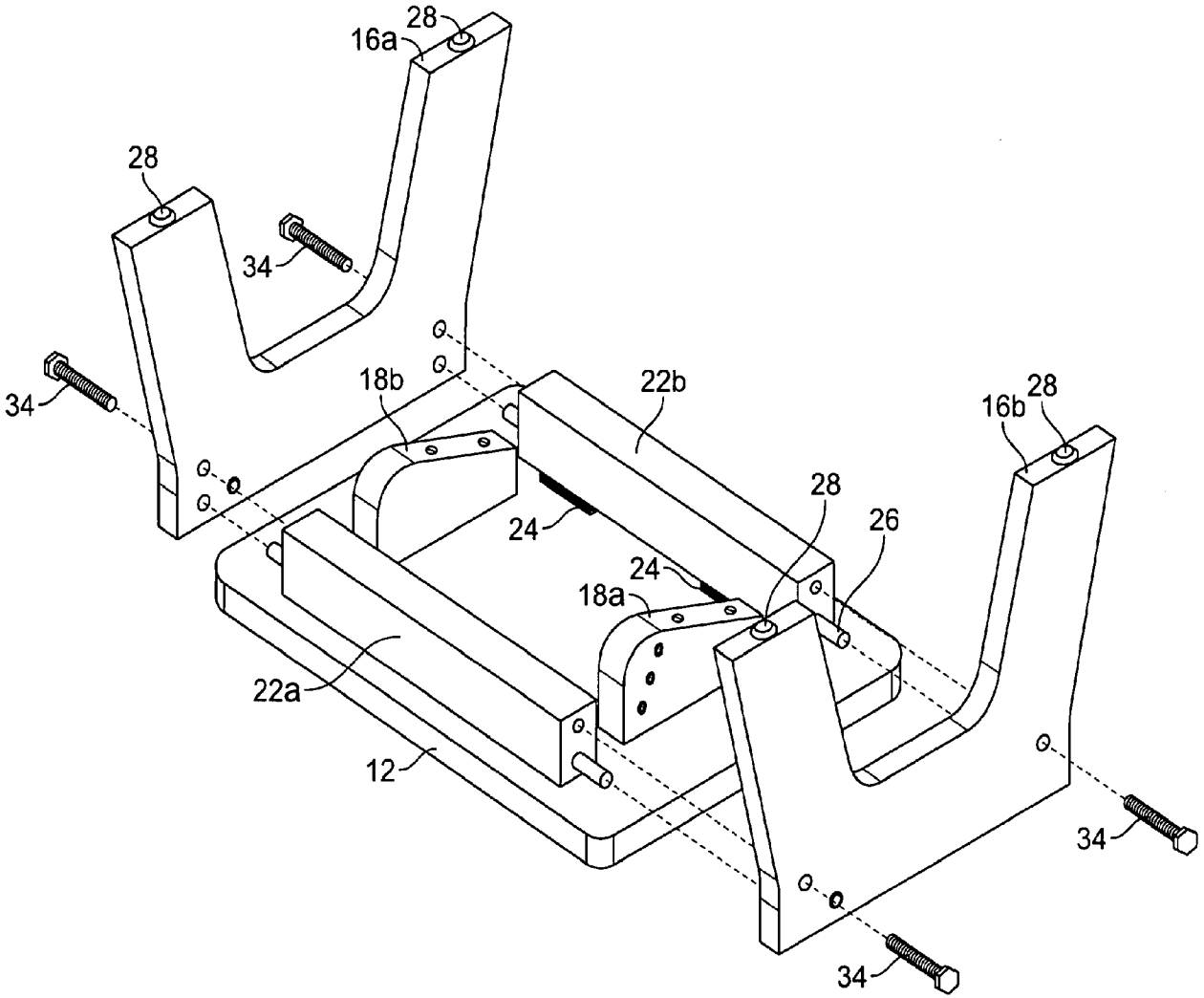
FIG. 4B is a simplified schematic diagram of a bottom perspective view illustrating the assembled adjustable stool in accordance with one embodiment of the invention.

FIG. 4A is a simplified schematic diagram of a bottom perspective view of the partially assembled adjustable stool in accordance with one embodiment of the invention. Support blocks 18*a* and 18*b* are affixed to a bottom surface of top plate 12. Beam 22*b* is coupled to the bottom surface of top plate 12 through hinges 24. Thus, through the coupling with hinges 24, top plate 12 will pivot around an axis of hinges 24. Dowels 26 extend from opposing ends of being 20 to be in order to assist in supporting the footplates for the adjustable stool. It should be noted that support blocks 18*a* and 18*b* move with top plate 12 as the top plate pivots.

FIG. 4B is a simplified schematic diagram of a bottom perspective view illustrating the assembled adjustable stool in accordance with one embodiment of the invention. Support blocks 18*a* and 18*b*, as well as beams 22*a* and 22*b* are affixed to a bottom surface of top plate 12. As discussed above beam 22*b* is affixed to the bottom surface of top plate 12 through hinges 24. It should be appreciated that the frame support surfaces against the bottom surface of top plate 12 defined through beams 22*a*, 22*b*, and support blocks 18*a* and 18*b*, form a planar surface that supports a bottom surface of top plate 12 in a flat position. Footplates 16*a* and 16*b* are coupled to beams 22*a* and 22*b* through dowels 26 and bolts 34, in one embodiment. It should be noted that footplates 16*a* and 16*b* are not directly coupled to top plate 12. That is, footplates 16*a* and 16*b* provide a support structure for the adjustable stool along with beams 22*a* and 22*b*. This support structure is completely disposed under a bottom surface of top plate 12 and remains stationary as top plate 12 is adjusted. Beam 22*b* is directly coupled to top plate 12, as well as support blocks 18*a* and 18*b*, while beam 22*a* is not coupled to top plate 12. Beam 22*a* remains stationary as mentioned above, however, support blocks 18*a* and 18*b* pivot along with top plate 12. It should be noted that support blocks 18*a* and 18*b* are disposed within a region encompassed by footplates 16*a* and 16*b* and beams 22*a* and 22*b*. Support blocks 18*a* and 18*b* are spaced apart from the side surfaces of footplates 16*a* and 16*b* and beams 22*a* and 22*b* in one embodiment. The bottom surface of the leg extensions of footplates 16*a* and 16*b* may include a compliant member 28, which may be composed of rubber in one embodiment. Bolts 34 affix beams 22*a* and 22*b* to footplates 16*a* and 16*b* in one embodiment.

Figure 5:
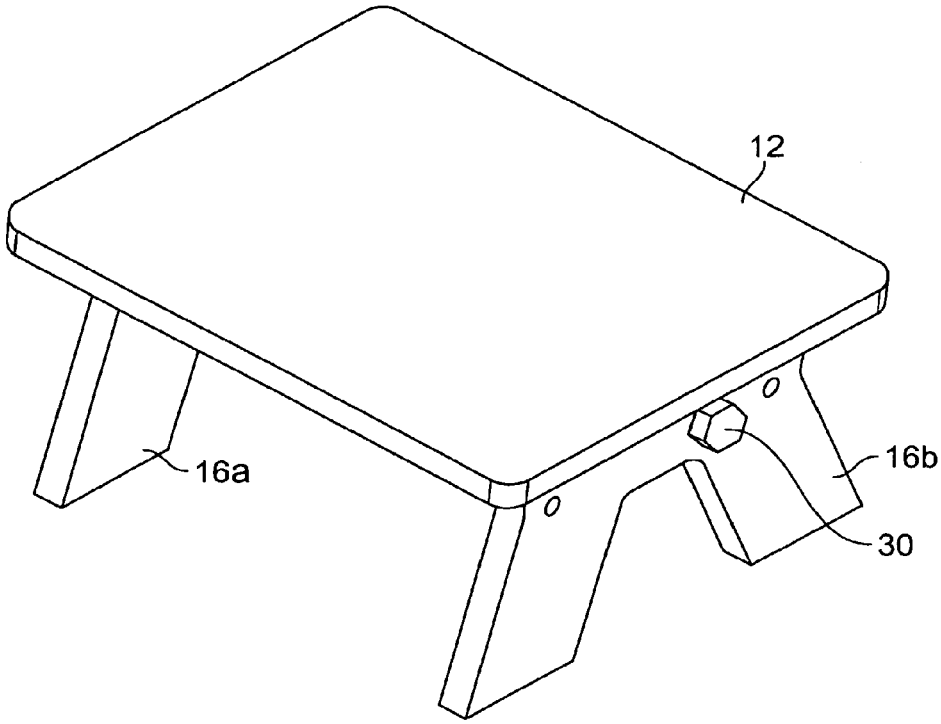
FIG. 5 is a simplified schematic diagram illustrating a perspective top view of an assembled adjustable stool in accordance with one embodiment of the invention.

FIG. 5 is a simplified schematic diagram illustrating a perspective top view of an assembled adjustable stool in accordance with one embodiment of the invention. Top plate 12 is disposed over the support structure which includes foot plates 16*a* and 16*b*, as well as the beams and support blocks discussed with reference to FIGS. 4A and 4B. Holding member 30 is provided in order to couple footplates 16*a* and 16*b* to one of the holes 20*a* through 20*c* of the corresponding support blocks as illustrated in FIG. 3. It should be noted that while three adjustable levels are provided on support blocks 18*a* and 18*b*, this is not meant to be limiting, as any suitable number of adjustable levels may be provided.

The adjustable stool described above provides the comfort afforded through the angular adjustment of the top plate. In addition, the adjustable stool may also function as a regular stepping stool when the top plate is in a flat or resting position. The materials of construction for the components listed above may be any suitable rigid material, e.g., wood, plastic, metal, etc.

Although the foregoing invention has been described in some detail for purposes of clarity of understanding, it will be apparent that certain changes and modifications can be practiced within the scope of the appended claims. Accordingly, the present embodiments are to be considered as illustrative and not restrictive, and the invention is not to be limited to the details given herein, but may be modified within the scope and equivalents of the appended claims.

What is claimed is:

1. A support stool, comprising:

a pivotable top plate;

a first support beam pivotably affixed to a bottom surface of the top plate;

a first support block and a second support block affixed to the bottom surface of the top plate;

first and second footplates coupled to corresponding ends of the first support beam and a second support beam, wherein the first and second support blocks are spaced apart from opposing side surfaces of the first and second support beams; and a first holding member extending through the first footplate and extending partially into a surface of the first support block.

2. The support stool of claim 1 further comprising:

a second holding member extending through the second footplate and extending partially into a surface of the second support block.

3. The support stool of claim 1 wherein the first and the second support blocks each include a plurality of holes extending partially into corresponding surfaces of the first and the second support blocks, the plurality of holes configured to maintain a constant distance from an axis of a pivot point of the pivotable top plate as the pivotable top plate moves.

4. The support stool of claim 3, wherein each of the plurality of holes is a fixed radial distance from the pivot point.

5. The support stool of claim 1 wherein the first and the second support blocks move with the pivotable top plate, while the first and second support beams and the first and second footplates are fixed in position.

6. The support stool of claim 1, wherein each of the first and the second footplates include a pair of leg extensions angled outward.

7. A support stool comprising:

a top plate;

a first footplate and a second footplate;

a first beam and a second beam each being affixed to opposing surfaces of the first footplate and the second footplate, the first beam pivotably mounted to a bottom surface of the top plate; and a first support block and a second support block affixed to the bottom surface of the top plate, the first support block and the second support block are disposed within a region encompassed by the first footplate, the second footplate, the first beam, and the second beam.

8. The support stool of claim 7 wherein the first support block and the second support block are spaced apart from side surfaces of the first footplate, the second footplate, the first beam, and the second beam.

9. The support stool of claim 7 further comprising;

a pair of hinges affixed to a bottom surface of the first beam and the bottom surface of the top plate.

10. The support stool of claim 9, wherein the bottom surface of the first beam includes a cavity where each of the pair of hinges is affixed.

11. The support stool of claim 7, further comprising:

first and second holding members extending through first and second support blocks, respectively.

12. The support stool of claim 11, wherein the first and the second holding members extend partially into outer surfaces of the first and the second support blocks, respectively.

13. The support stool of claim 7, wherein a top surface of the top plate includes a plurality of textured strips.

14. The support stool of claim 7, wherein outer surfaces of the first and the second support blocks each include a plurality of radially oriented holes extending partially into the first and the second support blocks.

15. The support stool of claim 14, wherein each of the first footplate and the second footplate include a hole extending therethrough, the hole extending therethrough is aligned with one of the plurality of radially oriented holes.

16. The support stool of claim 15, wherein each of the hole extending therethrough and the plurality of radially oriented holes is at a fixed distance from a pivot axis of the top plate.

17. A support stool, comprising:

a pivotable top plate;

a first support beam pivotably affixed to a bottom surface of the top plate;

a first support block affixed to the bottom surface of the top plate;

first and second footplates coupled to corresponding ends of the first support beam, each of the first and second footplates having a pair of leg extensions, wherein the first support block is spaced apart from a side surface of the first support beam and is proximate to one of the first footplate or the second footplate; and a first holding member extending through the first footplate and extending partially into a surface of the first support block.

* * * * *